United States Patent [19]

Vecchi

[11] Patent Number: 4,925,081

[45] Date of Patent: May 15, 1990

[54] STRIP MATERIAL FEED GUIDE

[75] Inventor: John C. Vecchi, Natrona Heights, Pa.

[73] Assignee: J. V. Manufacturing Company, Inc., Natrona Heights, Pa.

[21] Appl. No.: 339,224

[22] Filed: Apr. 17, 1989

[51] Int. Cl.[5] ..... B65H 23/04

[52] U.S. Cl. ..... 226/199

[58] Field of Search ..... 83/449, 466; 226/199, 226/196; 242/76

[56] References Cited

U.S. PATENT DOCUMENTS

| | | | |
|---|---|---|---|
| 1,019,295 | 3/1912 | Bazley | 226/187 |
| 2,670,953 | 3/1954 | Marsilius | 226/141 |
| 2,981,453 | 4/1961 | Kinzelman | 226/23 |
| 3,123,270 | 3/1964 | Olson | 226/196 X |
| 3,139,963 | 7/1964 | Nädler et al. | 193/37 |
| 3,166,225 | 1/1965 | Sirugue | 226/9 |
| 3,468,464 | 9/1969 | Olson et al. | 226/141 |
| 3,866,502 | 2/1975 | Brewer, Sr. | 83/449 X |
| 4,059,212 | 11/1977 | Ledgerwood | 226/141 |
| 4,513,899 | 4/1985 | Ledgerwood | 226/199 X |

*Primary Examiner*—Stanley N. Gilreath
*Assistant Examiner*—Paul T. Bowen
*Attorney, Agent, or Firm*—Carothers & Carothers

[57] ABSTRACT

A strip material feed guide including elongated rod-like guide elements which extend longitudinally of the path of travel of a material strip to guide such a material strip by engaging opposed surfaces thereof, and including selectively adjustable supports for the rod-like guide elements which permit the selective positioning thereof laterally with respect to the strip material being guided thereby.

10 Claims, 2 Drawing Sheets

STRIP MATERIAL FEED GUIDE

BACKGROUND OF THE INVENTION

In the material processing arts there are known numerous examples of systems which are adapted to process an elongated continuous strip of sheet form material for example, in the metal working arts it is known to process a metallic sheet or strip by continuously feeding the strip to a processing machine which performs any of a variety of operations thereon including but not limited to embossing, stamping, die cutting, and other cutting or forming operations.

In virtually all such operations it is a well known requirement that the strip of sheet for material supplied to the processing machinery, especially i; provided as a continuous strip, must be carefully guided in a predetermined path of travel to the infeed of the processing machinery. Various sorts of feed guides for both strip or sheet form material and for discreet objects are well known. These include most commonly roller or continuous belt type conveyors.

Examples of prior material feed or guide apparatus include the following. U.S. Pat. No. 1,019,295 discloses a feed roll arrangement for feeding strip material which contemplates intermittent release of the strip being fed to allow the strip of material to reside under its preferred position if, under the influence of the feed rollers, it has tracked laterally to one side or the other of its preferred feed path. U.S. Pat. No. 3,123,270 discloses a pneumatically operated feed mechanism with cross members which reciprocate longitudinally of a guide frame under the impetus of fluid operated piston and cylinder apparatus to feed stock material to a press. U.S. Pat. No. 3,166,225 discloses a roll conveyor apparatus. U.S. Pat. Nos. 3,139,963 and 2,981,453 disclose other guide roller apparatus. U.S. Pat. No. 3,468,464 discloses another pneumatic or fluid operated feed apparatus. Other U.S. patents pertaining to stock feeders include U.S. Pat. Nos. 4,059,212 and 2,670,953.

Practitioners of the art have continually sought new and improved apparatus to facilitate stock or material feed especially although not exclusively in production systems requiring continuous high rate stock material feed.

BRIEF SUMMARY OF THE INVENTION

The present invention contemplates a novel and improved stock material feed guide apparatus which is adapted to guide an elongated strip of sheet for material to the infeed of a processing machine. The apparatus of the present invention contemplates guides in the for of a plurality of elongated rod-like guide elements which extend in mutually parallel relation longitudinally of the strip material being fed; that is, the rod-like guides extend in the direction of movement of the strip material as it is fed to the processing machinery.

Two sets of rod-like guide elements are provided, each set being positioned adjacent one of the two opposed surfaces of the strip material to thereby guide the strip material between the respective opposed sets of rod elements. In each of the two sets of rod elements the individual rods are supported adjacent their respective opposed longitudinal ends by a pair of longitudinally spaced laterally extending support members which include means to accommodate selective repositioning of the rod elements laterally with respect to the strip material being guided thereby.

The invention also contemplates adjustable supports which permit the respective sets of rod-like guide elements to be positioned selectively according to the desired path of travel through which the strip material is to be guided.

The invention thus provides a feed guide apparatus of simple and inexpensive construction which is readily adjustable according to variations in strip material width, thickness, desired path of movement and the like.

It is therefore one object of the present invention to provide a novel and improved strip material feed guide apparatus.

A more specific object of tho invention is to provide a strip material feed guide apparatus comprised of pluralities of mutually parallel upper and lower rod-like guide elements extending longitudinally with respect to the direction of feed of a strip of material to be guided thereby such that the strip material is confined between the respective upper and lower pluralities of rod elements.

Further object of the invention is to provide a readily adjustable feed guide apparatus for accommodation to feeding strip mate rial of varying dimensions and for feeding thereof to or between a wide variety of differing types of processing machinery.

These and other objects and further advantages of the invention will be more fully appreciated upon consideration of the following detailed description and the accompanying drawings, in which.

Figure 1:
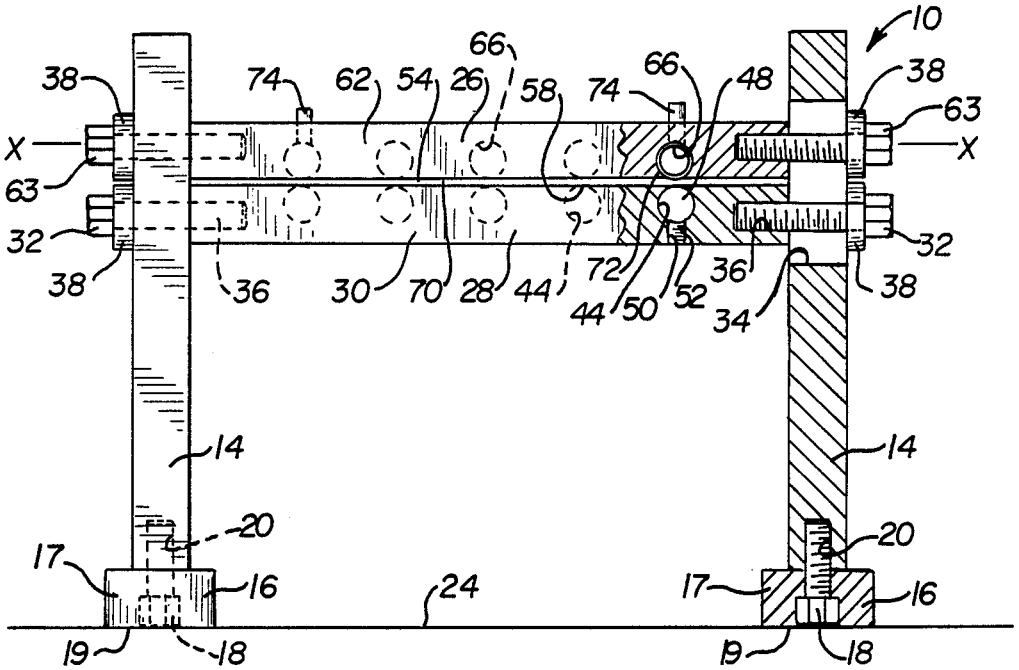
FIG. 1 is an end elevational view, partially sectioned, of a feed guide apparatus according to one presently preferred embodiment of the instant invention.

There is generally indicated at 10 in FIG. 1 a strip material feed guide apparatus according to one presently preferred embodiment of the instant invention and comprising a pair of laterally spaced, upstanding forward support elements 12 and a similar pair of laterally spaced upstanding rearward support elements 14. Each of the upstanding support elements 12 and 14 is secured to a base element 16 as by means of a suitable fastener, for example a bolt 16 which is threaded into a cooperably threaded blind bore 20 that extends upwardly from the lowermost end of the respective support elements 12 and 14. Each base element 18 is comprised of an elongated member 17 which is affixed adjacent one longitudinal end thereof to the respective upstanding support 12 or 14. Each member 17 includes an elongated sot 22 which extends longitudinally thereof and is adapted to receive a suitable clamping bolt (not shown) for the purpose of securing the apparatus 10 in a selected position as on a base such as indicated at 24. Typically base 24 is a generally flat surface and elements 17 thus include flat lower surface portions 19 for engagement upon base 24.

The respective pairs of support elements 12 and 14 each are arranged in laterally spaced relationship with upper and lower guide assemblies 26 and 28 extending laterally thereof and longitudinally between the respective pairs of support elements 12 and 14. The lower guide assembly 28 comprises a first laterally extending support or rod carrier member 30 which extends laterally intermediate the pair of laterally spaced support members 14 and is secured adjustably with respect thereto as by respective bolts 32 which pass through a vertically extending elongated slot 34 formed in each respective member 14. Bolts 32 are threadedly engaged within respective threaded bores 36 extending end rise into the opposed ends of member 30. Bolts 82 may be recessed hex drive cap screws or standard external hex head bolts as shown. Washers 38 may be utilized to accommodate the requisite clamping forces to clamp and retain member 30 in the desired position with respect to support members 14 as shown.

Figure 2:
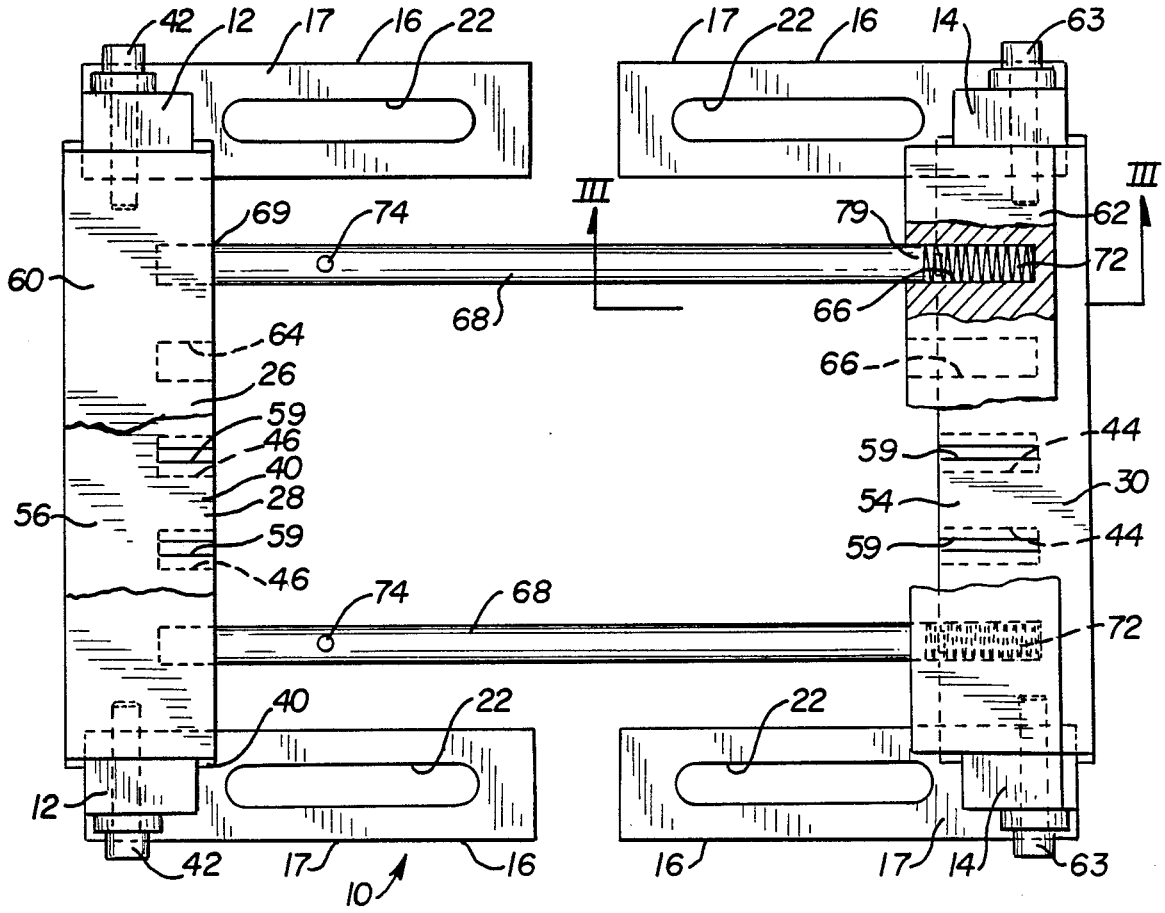
FIG. 2 is a top plan view of the apparatus of FIG. 1.

Lower guide assembly 28 further comprises another support member 40 (FIG. 2) which extends laterally between the upstanding supports 12 and is adjustably affixed with respect thereto by bolts 42 in substantially the safe manner as above described with regard to support member 30.

Each of the support members 30 and 40 is provided with a plurality of parallel, laterally spaced blind bores 44 and 46, respectively. In the assembled apparatus each bore 44 opens toward a bore 46 in axial alignment therewith to provide respective pairs of opposed longitudinally spaced and axially aligned bores 44, 46 to receive and retain rod-like guide elements 48 as described hereinbelow.

In one of the members 30 or 40, each respective bore 44 or 46 is intersected by a transversely extending threaded bore 50 into which a set screw 52 is received to be selectively engaged with a longitudinal end of a rod-like element 48 that is received within the respective bore 44 or 46. The rod elements 48 thus may be fixedly but releasably retained within the respective bores 44 or 46. Since each support element 30 and 40 is provided with a plurality of the laterally spaced bores 44 and 46, rod-like guide elements 48 may be positioned at selected laterally spaced positions and secured by means of set screws 52 in the positions thus selected.

It will be noted that bores 44 and 48 are not formed entirely within profile of the respective members 30 and 40. That is as shown most clearly in FIG. 1, the upper surface 54, 56 of each member 30 and 40 respectively, forms a chord segment 48 which intersects each of bores 44 and 46 to form a laterally open slot 59 which extends substantially the entire axial length of each respective bore 44 and 46. The rod elements 48 received within respective bores 44 and 46 thus project above the respective surfaces 54 and 58 of members 30 and to provide engagement or guide surfaces which are engageable with an adjacent strip of sheet for material.

The upper guide assembly 28 is similar in many salient respects to the above described lower guide assembly 28, having laterally extending forward and rearward support members 60 and 62 which are secured with respect to the respective upstanding support elements 12 and 14 as by bolts 63. Each support member 60 and 62 is provided with a plurality of laterally spaced, parallel blind bores 64, 66, respectively, which receive rod-like guide elements 68 in a manner similar to that described above with reference to rod elements 48.

Also like the lower guide assembly 28, the bores 64 and 66 of upper guide assembly 26 are intersected by chords formed by the respective lower surfaces 70 of support members 60 and 62 such that the rod elements 68 project beneath the surfaces 70 of members 60 and 62, respectively. The bores 64 and 66 are arranged in opposed coaxial pairs as are bores 44 and 46, and preferably are to be spaced laterally of the respective members 60 and 62 at the same or different lateral positions as are bores 44 and 46 above described.

Figure 3:
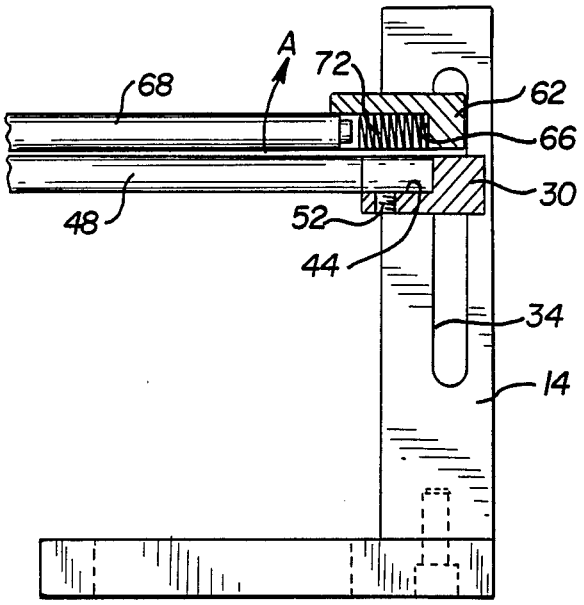
FIG. 3 is a fragmentary sectional view taken on line III—III of FIG. 2.

Each rod element 68 is retained with its opposed longitudinal ends in a pair of the bores 64 and 46 by spring bias means in order to accommodate easy repositioning of rod elements 68. More specifically each of bores 66 receives therein an elongated coil spring 72 which is axially compressible to receive a longitudinal end 79 of a rod element 68 therein. Accordingly, to selectively position rod elements 68, bolts 63 which secure member 62 with respect to the upright supports 14 are slackened to permit rotation of the member 62 in the direction indicated by arrow A (FIG. 3) about the axis X—X formed by tho bolts 63.

Rod elements 68 are pushed into respective bores 66 to compress the springs 72 therein and thereby release the opposed ends 69 of the rod elements 68 from the respective opposed bores 64. The rod elements 68 then may be pulled upwardly to pivot member 62 upwardly in the direction of arrow A to a position where the rod elements 68 may be removed from the respective bores 66 and reinserted in others of the bores 66 to reposition the rod elements 68 as desired.

Thereafter upon pushing the rod elements 68 into bores 66 against the bias of the respective springs 72 and rotating the member 62 downward again, the opposed ends 69 of the rod elements 68 are again brought into alignment with the respective bores 64 and the rod elements 68 may then be released whereupon the bias of springs 72 urges the opposed ends 69 of the rod elements 68 into bores 64 and the rod elements 68 are again retained captivity by the respective pairs of bores 64 and 66. Bolt then be retightened to secure member 62 at the desired elevation with respect to underlying guide assembly 28.

According to the above description, it will be seen that the opposed longitudinal ends of the upper and lower guide assemblies 26 and 28 may be independently adjusted vertically with respect to the respective upstanding supports 12 and 14 to provide a desired infeed or outfeed guide configuration. In addition, the lateral positioning of rod elements 68 of the upper guide assembly 26 may be readily repositioned as above described substantially without disassembly of the entire guide apparatus. In order to assure proper and convenient operation of the described repositioning or change-out procedure for rod elements 68, it is necessary that the overall length of the rod elements 68 must correspond to the longitudinal spacing between the respective pairs of bores 64 and 66 such that with the rod 68 fully inserted into a bore 64, its opposed longitudinal end 74 remains confined within at least a portion of the length of the respective bore 68 and maintained in biased engagement with the spring 72 therein. Likewise the overall length of rod elements 68 must be such that upon movement thereof into a respective bore 66, sufficient compressive deformation of spring 72 is available to permit release of the opposed longitudinal end 69 of the rod element 68 from the respective bore 64.

Of course, it desired both the upper and lower guide assemblies 26 and 28 may be provided with a spring bias rod element retention arrangement as above described with respect to upper guide assembly 26. Additional or ancillary features of the invention may include handle or grasping elements 74 affixed to and projecting upwardly of rod elements 68 which are used to manipulate the rod elements 68 in repositioning of the same.

Figure 4:
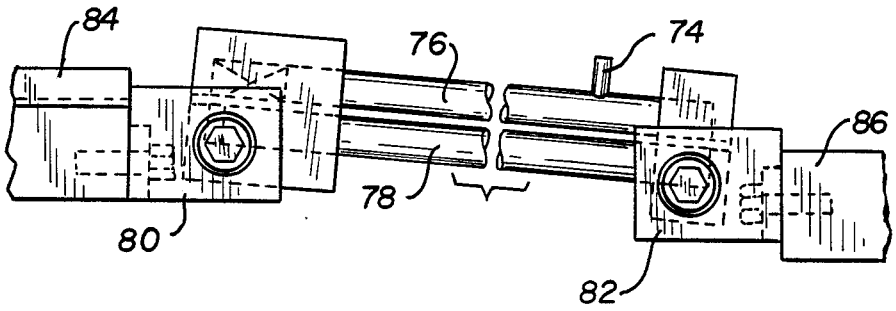
FIG. 4 is a side elevational view of an alternative embodiment of the invention.

FIG. 4 illustrates an alternative embodiment of the invention wherein the upper and lower guide assemblies are combined as a single assembly of elements with a given spacing, fixed or variable, between the respective upper and lower rod guide elements 76 and 78. In addition, alternative support elements 80, 82 are provided in lieu of upstanding supports 12 and 14 to affix the feed guide assembly with respect to infeed and/or outfeed table or apron portions 84 86 of adjacent machinery.

In addition to the above presently preferred embodiments of the invention, I have contemplated various other alternative and modified embodiments which would certainly also occur to others versed in the art, once apprised of by invention. For example, springs 72 may be provided with suitable retention elements to retain them within the bores 66 so that no need arises to take precautions against the springs 72 self-ejecting from bores 66 during repositioning of rod elements 68. It is therefore by intention that the invention should be construed broadly and limited only by the scope of the claims appended hereto.

I claim:

1. A guide apparatus for guiding thin section sheet form material along a given path of movement comprising:

a rigid support means adapted to be positioned with respect to such a given path of movement;

a first elongated guide means supported by said support means adjacent such a given path of movement;

a second elongated guide means supported by said support means with respect to said first guide means such that an expanse of such sheet form material moving along such a given path will have the opposed surfaces thereof disposed in confronting relationship to said first and second guide means;

at least one of said first and second guide means including a plurality of laterally spaced elongated rod elements extending longitudinally of such a give path of movement and each said rod element having longitudinally opposed end portions;

said at least one of said guide means additionally including a pair of rod carrier means supported by said support means and engageable with the respective said opposed end portions of said rod elements to support said rod elements with respect to such a given path of movement;

said rod elements having surface portions extending longitudinally thereof which are adapted to engage one of the opposed surfaces of such an expanse of sheet for material; and said rod carrier means including means cooperable with the respective said opposed end portions of said rod elements to permit selective positioning of said rod elements at any of a plurality of predetermined lateral positions with respect to such a given path of movement.

2. The apparatus as set forth in claim 1 additionally including means for adjustably securing said first and second guide means with respect to said support means.

3. The apparatus as set forth in claim 2 wherein said rod carrier means includes elongated bar means extending laterally of such a path of movement between a laterally spaced pair of said support means and said means for adjustably securing includes means for clamping the opposed longitudinal ends of said elongated bar means with respect to the respective said support means.

4. The apparatus as set forth in claim 3 wherein each of said bar means includes a plurality of laterally spaced bore means each of which is adapted to receive a respective said longitudinal end of any selected one of said rod elements.

5. The apparatus as set forth in claim 4 wherein at least one of said bar means includes spring biasing means received in the respective said bore means or biased retention of said rod elements.

6. The apparatus as set forth in claim 5 wherein said spring biasing means includes longitudinally compressible springs received in said respective bore means for cooperation with the respective longitudinal ends of selected ones of said elements to maintain the opposed longitudinal ends of said selected ones of said rod elements in biased engagement within the respective said bore means in the other of said support elements.

7. The apparatus as set forth in claim 4 wherein said bore means are formed only partially within said laterally extending bar means and are laterally open on one side of the respective said laterally extending bar means such that a radially outer extent of the respective said rod elements projects laterally outwardly of each respective said laterally extending bar means.

8. The apparatus as set forth in claim 7 wherein said radially outer extent of each said rod element which projects laterally outwardly of the respective said laterally extending bar means includes said surface portions which are adapted to engage such surfaces of an expanse of sheet form material.

9. The apparatus as set forth in claim 1 wherein said rod carrier means includes a respective pair of laterally extending elements, at least one of said laterally extending elements being adjustably affixed with respect to the respective said support means for pivotal movement with respect thereto about a respective axis extending laterally of such a given path of movement.

10. The apparatus as set forth in claim 1 wherein both of said first and second guide means include a plurality of laterally spaced elongated rod elements extending longitudinally of such a path of movement.

* * * * *